US005930915A

United States Patent [19]

Dhaemers

[11] Patent Number: 5,930,915

[45] Date of Patent: Aug. 3, 1999

[54] BAG WITH AIR DISTRIBUTOR AND METHOD FOR REMOVING MOISTURE AND ODORS FROM WITHIN THE BAG

[76] Inventor: Gregory L. Dhaemers, 108 N. 58th St., Superior, Wis. 54880

[21] Appl. No.: 09/111,440

[22] Filed: Jul. 7, 1998

Related U.S. Application Data

[60] Provisional application No. 60/052,487, Jul. 14, 1997.

[51] Int. Cl.[6] ..... F26B 9/00

[52] U.S. Cl. ..... 34/511; 34/60; 34/622; 34/202; 34/233; 34/235

[58] Field of Search ..... 34/618, 619, 621, 34/622, 202, 218, 233, 235, 60, 511

[56] References Cited

U.S. PATENT DOCUMENTS

| | | | |
|---|---|---|---|
| 3,432,939 | 3/1969 | Eichholz | 34/622 |
| 3,487,557 | 1/1970 | Linstead | 34/619 |
| 3,513,564 | 5/1970 | Gramprie | 34/104 |
| 3,577,650 | 5/1971 | Brahm | 34/622 |
| 3,626,602 | 12/1971 | Glowacki | 34/622 |
| 3,805,561 | 4/1974 | Bullock | 68/5 C |
| 4,145,602 | 3/1979 | Lee | 392/382 |
| 4,677,764 | 7/1987 | Cerny | 34/195 |
| 5,369,892 | 12/1994 | Dhaemers | 34/275 |
| 5,528,840 | 6/1996 | Pajak et al. | 34/622 |
| 5,546,678 | 8/1996 | Dhaemers | 34/275 |

*Primary Examiner*—Henry Bennett
*Assistant Examiner*—Pamela A. Wilson
*Attorney, Agent, or Firm*—Burd, Bartz & Gutenkauf

[57] ABSTRACT

A portable sport equipment bag having an air distributor is connected with a hose to blower operable to move air under pressure into the air distributor. The air distributor has one or more manifolds located within the bag. The manifolds have a plurality of holes to allow air in the manifolds to flow into the bag to dry sport equipment and objects within the bag. One or more air filters mounted on the bag remove odors and foreign matter from the air flow from the bag into the environment adjacent the bag.

38 Claims, 12 Drawing Sheets

BAG WITH AIR DISTRIBUTOR AND METHOD FOR REMOVING MOISTURE AND ODORS FROM WITHIN THE BAG

CROSS REFERENCE TO RELATED APPLICATION

This application is a continuation of U.S. Provisional Application Ser. No. 60/052,487, filed Jul. 14, 1997.

FIELD OF THE INVENTION

The invention is in the field of portable bags having air distributors for air drying clothing, sporting and athletic equipment and air filters for removing odors from the air expelled from the bag.

BACKGROUND OF THE INVENTION

Damp garments, sport and athletic equipment, boots and shoes have been dried out in storage areas having natural air circulation. Garments and sport equipment that retain water will mold, mildew and have unpleasant odors without adequate removal of the water. G. L. Dhaemers in U.S. Pat. No. 5,369,893 discloses several self-contained dryers for accommodating articles, such as clothing, sporting equipment and shoes. The dryers have walls that cause heated air to re-circulate in the drying chambers to decrease the moisture content of the air and increase the drying energy efficiency. Blowers and fans associated with electric heaters operate to circulate heated air through the drying chambers. The dryer shown in FIG. 23 to 26 of U.S. Pat. No. 5,369,892 is a chest or foot locker structure having a rigid housing. Wheels and a handle attached to the housing are used to facilitate manual movement of the dryer. The top of the housing has a cover movable to an open position to allow access to the drying chamber. A motor driven fan located in an air mixing chamber within the housing draws air through a filter into the drying chamber. Air porous walls within the drying chamber allow air to flow from the drying chamber back to the air mixing chamber for re-circulation back into the drying chamber. Air also flows out of the drying chamber through a filter having activated charcoal to remove odors from the air discharge into the environment. This dryer requires an internal motor and fan associated with an electric heater, and specialized porous walls within a housing. While this dryer is effective to dry articles in the drying chamber it is complex and expensive to manufacture. The travel and sports bag equipped with an air distributor of the invention disclosed in this application is effective in air drying articles without complex and expensive structures.

SUMMARY OF THE INVENTION

The invention is a portable bag, known as a sport bag, having an internal chamber for storing articles, such as clothing, shoes, boots, ice skates, ski boots, sporting equipment and other objects. An air distributor located in the bottom of the chamber directs a plurality of streams of air into the chamber to dry the articles located in the chamber. Air under pressure is supplied to the air distributor with a blower connected to the air distributor projected into the chamber to supply air to hollow articles, such as gloves, shoes boots and ice skates. One or more air filters mounted on the bag allow air to flow out of the bag and remove odors and particulates from the air.

The bag is an elongated flexible container having side walls joined to end and bottom walls. The bag is made from canvas, vinyl, or fabric materials which allow it to be folded for storage and expanded for accommodating articles. One or more zippers or hook and loop releasable fasteners along the top of the bag functions to close the bag and allow access into the bag chamber to facilitate the introduction of articles into the bag chamber and removal of the articles from the bag. A modification of the bag includes side pockets for storing articles, such as shoes, ice skates and mittens. Air is introduced into the side pockets through tubular members mounted on the air distributor to dry the articles in the side pockets. Air filters mounted on the side pockets allow air to flow out of the side pockets and remove odors and particulates from the air. The air from the side pockets can be routed back into the chamber of the bag. The air will be exhausted from the chamber through the air filters mounted on the bag. The bag can have a longitudinal or vertical orientation. A vertical bag has a side wall containing a releasable closure providing admittance into the interior of the bag. An air distributor located at the bottom of the bag directs air up into the bag chamber to dry articles located within the bag chamber. An external blower discharges air into the air distributor.

The air distributor has one or more internal chambers for accumulating air under pressure supplied by an external located blower. The blower can be equipped with an electric heater operable to heat the air discharged by the blower into the air distributor. Holes in top wall of the air distributor dispense and spread out the air flow into the bag chamber so as to subject a large number of surfaces of the articles in the bag chamber to flowing air. This increases drying efficiency and reduces damp sections of the articles.

The air distributor has one or more manifolds that fit into the bottom of the bag. The manifolds are generally flat and utilize only a small amount of space in the bag chamber. When two or more manifolds are used for an air distributor they are hinged together to allow articulation between the manifolds. One manifold has an air inlet tube adapted to be coupled to the hose to receive air from the blower.

The moving air in the bag chamber picks up the moisture, foreign matter and odors from the articles stored in the bag chamber. The odors and foreign matter carried by the air are collected by the filters mounted on the bag. The filters have activated carbon or other odor reducing materials that remove odors from the air discharged into the environment.

DESCRIPTION OF PREFERRED EMBODIMENTS

Figure 1:
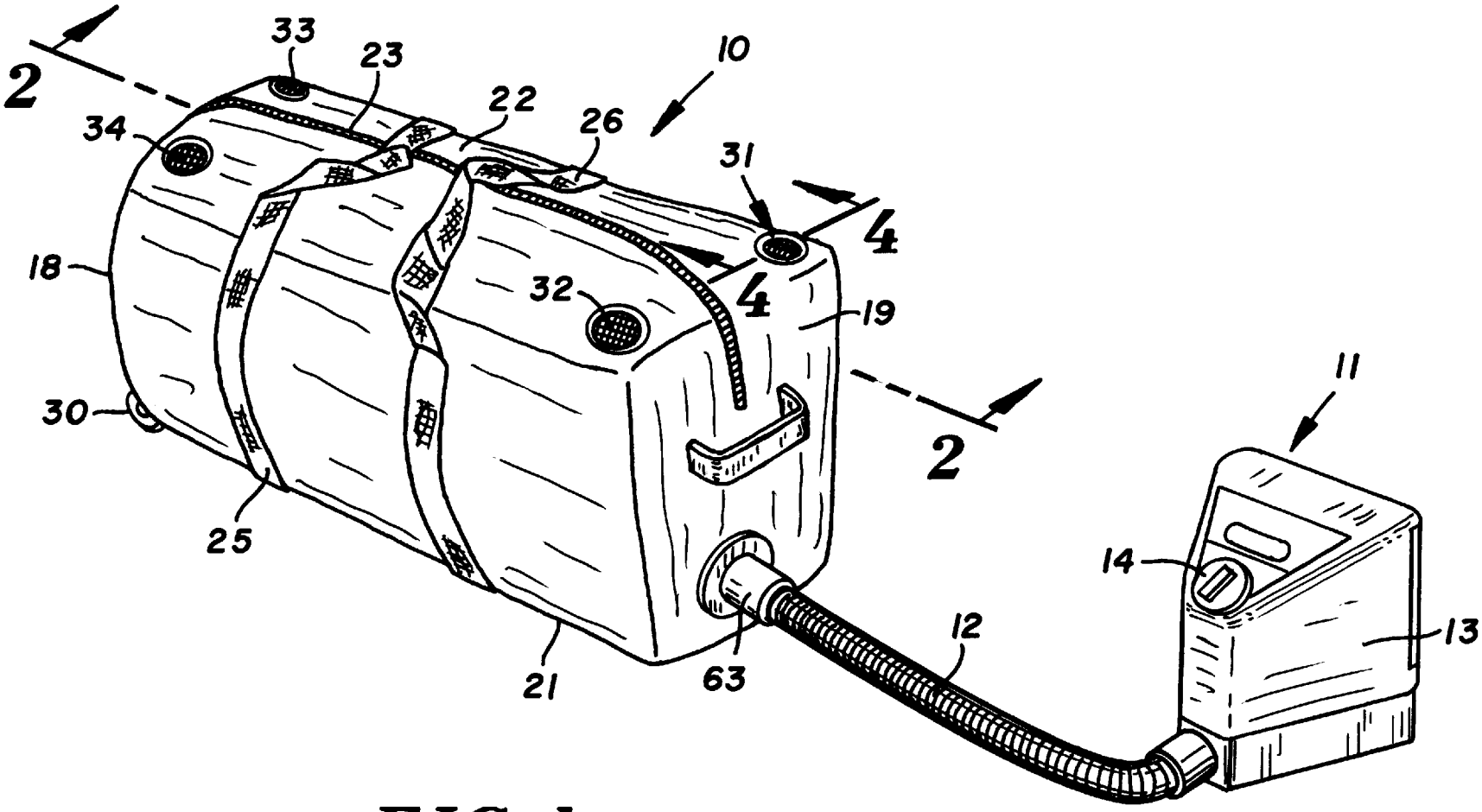
FIG. 1 is a perspective view of a travel and sport bag equipped with the air distributor of the invention connected to an air blower.

A travel and sports bag 10, shown in FIG. 1, is connected to an air blower or pump 11 with an elongated flexible hose 12. Bag 10 is a flexible canvas, plastic, vinyl, or cloth container or grip used to store and carry sports equipment, such as hockey, basketball, soccer, football, tennis, hand ball, and baseball equipment. The equipment stored in bag 10 is at times moist and wet due to the weather and body sweat. Air is moved through bag 10 to dry the equipment in the bag. An air blower 11 has an electric motor driving an impeller or fan to force air through hose 12 into an air distributor 44 located along the bottom of bag 10. The air flows out of distributor 44 into the bag chamber 24. The air flowing through bag 10 picks up moisture, foreign matter, and odors from the equipment and is discharged through filters 31–34 mounted on the bag to atmosphere.

Air blower 11 is an electric motor driven pump located within a casing 13. The timer 14 mounted on top of casing 13 controls the operation of the electric motor for a predetermined time and shuts off the motor. Blower 11 can be equipped with an electric heater whereby hot air is discharged into hose 12 and air distributor 44. A device operable to introduce a mist or vapors into the air intake of blower 11 to mitigate odors in bag chamber 24 and equipment stored therein can be operatively associated with blower 11. This device can be mounted on the blower.

Figure 3:
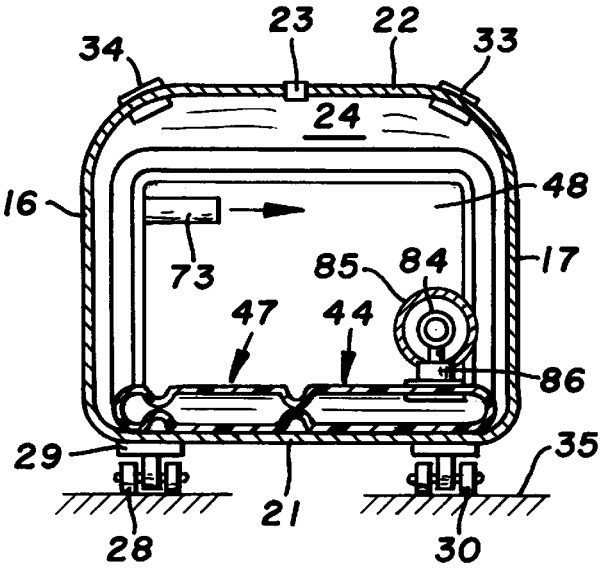
FIG. 3 is a sectional view taken along line 3—3 of FIG. 2.

Bag 11, as seen in FIG. 3, has upright side walls 16 and 17 joined to end walls 18 and 19. Walls 16–19 are joined to a generally flat bottom wall 21. The top wall 22 of bag 10 has a longitudinal zipper or linear releasable fastener 23 that extends into end walls 18 and 19 to facilitate access to the interior or bag chamber 24 comprising the storage area of bag 10 and allow the equipment to be placed into and removed from bag 10. Bag 10 can be made from canvas, fabric and plastic materials. A pair of straps 25 and 26 are secured to the side walls 16 and 17 of bag 10. The upper portions of straps 25 and 26 extend above top wall 22 of bag 10 and provide handles used to carry the bag. A second handle 27 is secure to end wall 19 to facilitate towing of bag 10. Two sets of wheels 28 and 30 are attached to opposite bottom ends of end wall 18 with brackets 29. Each set of wheels 28, 30 has a pair of rollers rotatable mounted on a transverse axle. Other types of wheels or rollers can be used to provide movable support for bag 10 on surface 35.

Figure 4:
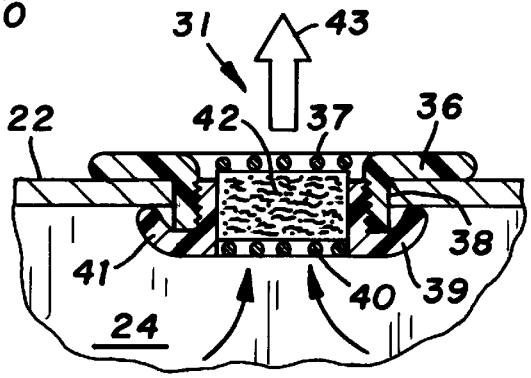
FIG. 4 is an enlarged sectional view taken along line 4—4 of FIG. 1.

Top wall 22 has air filters 31, 32, 33 and 34 in each corner to remove odors and foreign matter from the air allowing air to flow from bag chamber 24 to the atmosphere. The filters absorb odors and collect particulates that are carried by the air. As shown in FIG. 4, filter 31 extends through a hole 38 in top wall 22 and has a cap 36 having a first grid 37 threaded on a holder 39 having a second grid 40. Holder 39 has an annular lip 41 located in firm engagement with top wall 22 to clamp filter 31 on top wall 22. Air filtering materials 42 including activated charcoal, fiber materials, or other odor reducing materials are located within holder 39 to remove odor and foreign matter from the air. Screens on opposite sides of filtering materials 42 cooperate with the grids 37 and 40 to retain filtering materials 42 within holder 39. Filters 32, 33 and 34 have the same structure and function as filter 31. Air within chamber 24 flows through all filters 31–34, as shown by arrows 43, when zipper 23 is closed. The air filters 31, 32, 33, and 34 are removable from their holders to allow the filters to be replaced with new filters. The air filters can be replaceable cartridges accommodating odor removing materials.

Figure 2:
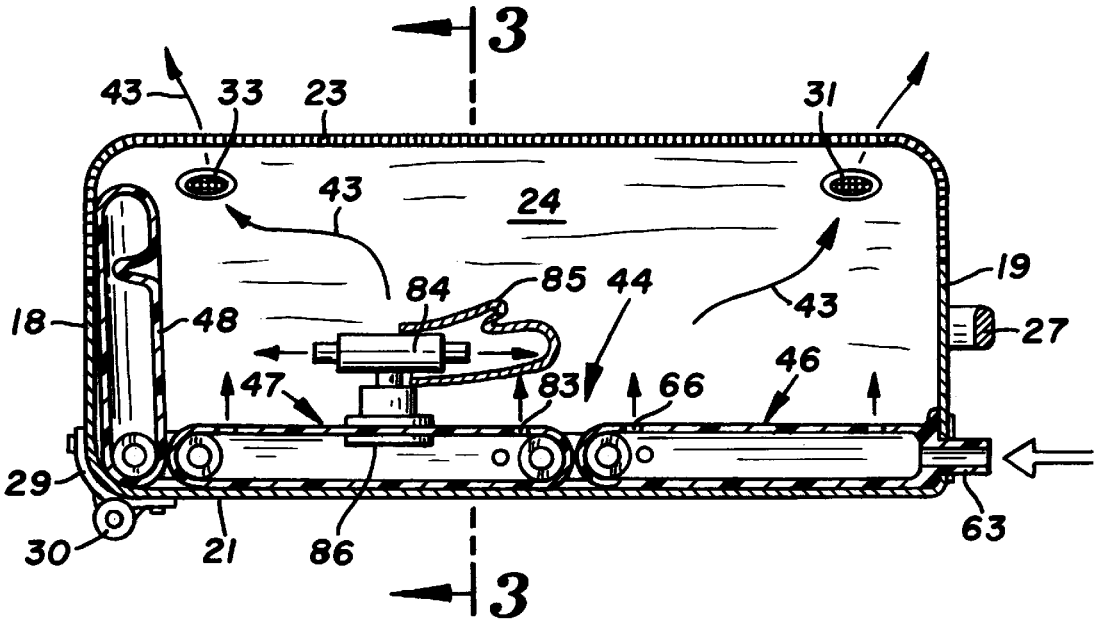
FIG. 2 is an enlarged section view taken along the line 2—2 of FIG. 1.
Figure 5:
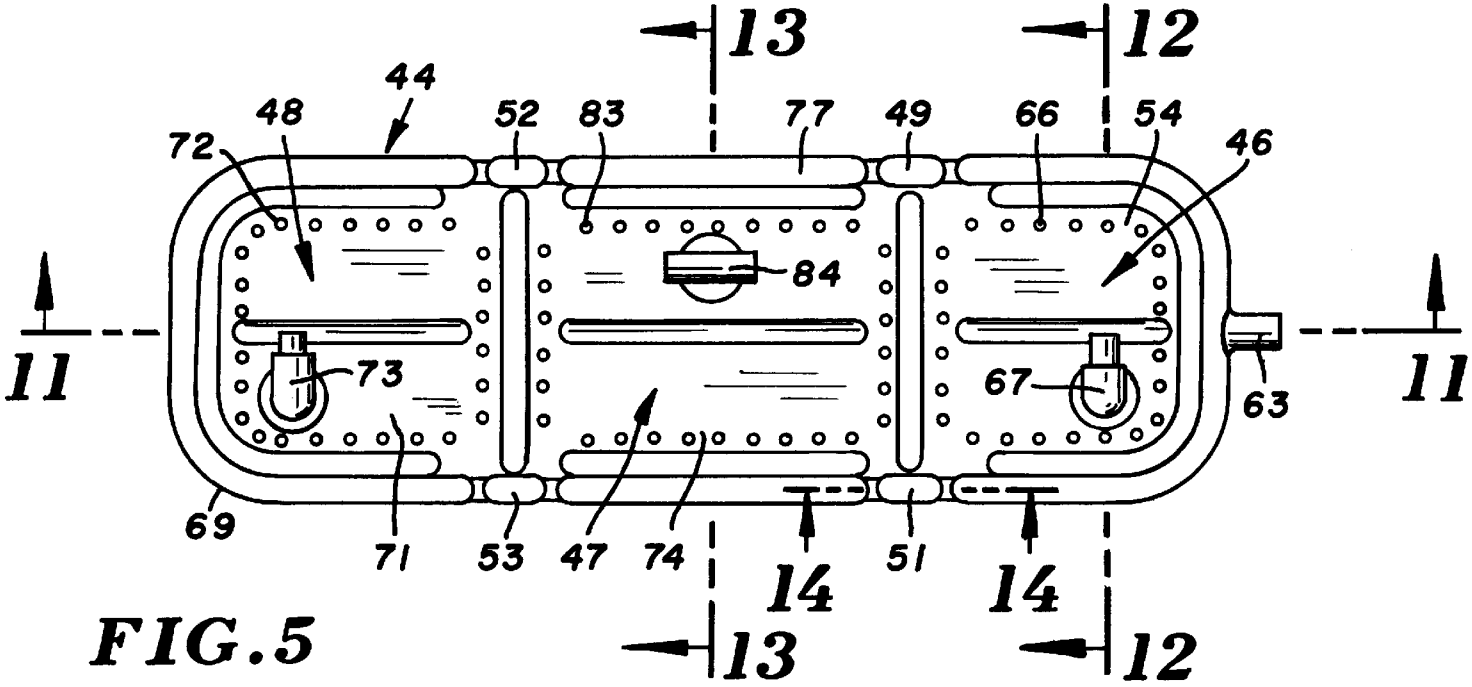
FIG. 5 is a top plan view of the air distributor.
Figure 6:
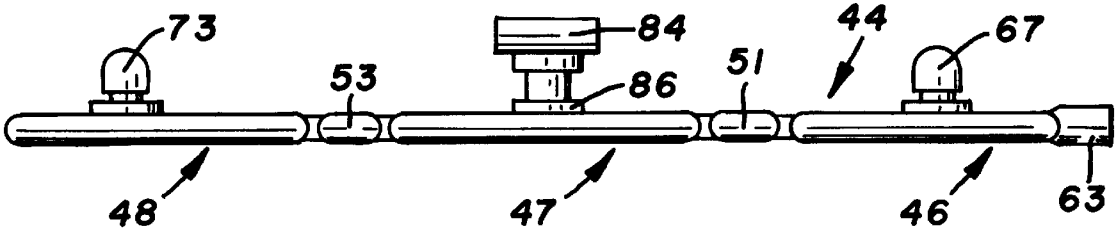
FIG. 6 is a side elevational view of the right side of the air distributor of FIG. 5.
Figure 7:
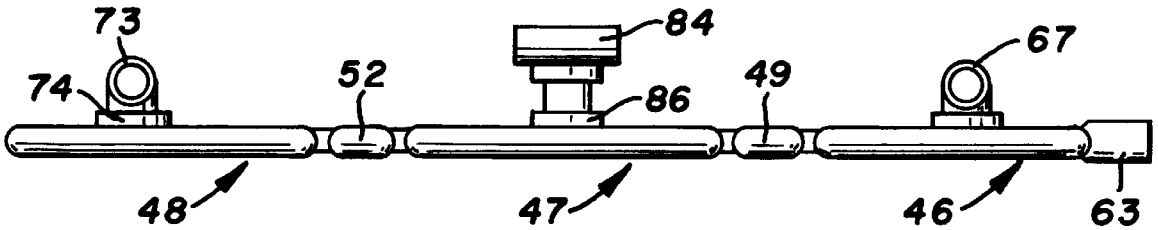
FIG. 7 is a side elevational view of the left side of the air distributor of FIG. 5.
Figure 9:
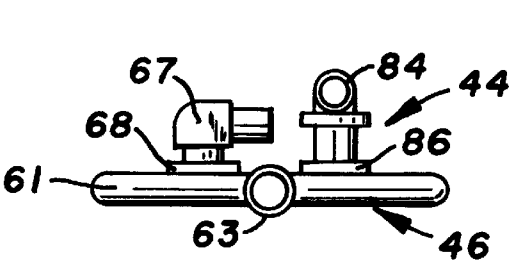
FIG. 9 is an end elevational view of the right end of the air distributor of FIG. 5.
Figure 8:
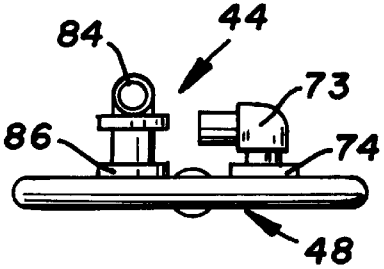
FIG. 8 is an end elevational view of the left end of the air distributor of FIG. 5.
Figure 10:
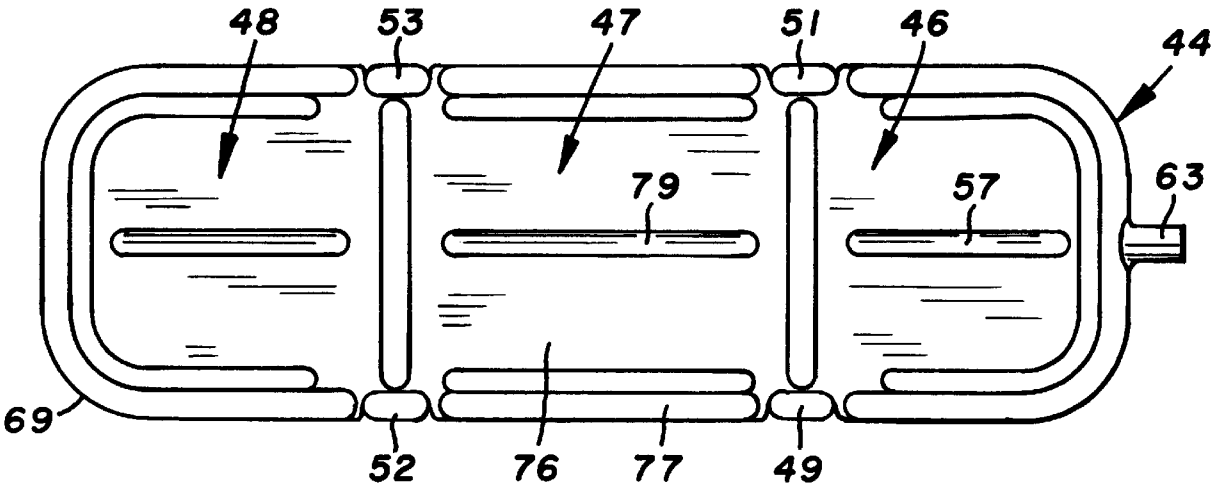
FIG. 10 is a bottom plan view of the air distributor of FIG. 5.

An air distributor, indicated generally at 44 in FIGS. 2, 3, and 5, located within chamber 24 on top of bottom 21 of bag 10 dispenses air into chamber 24. The air flows around the equipment and objects stored in bag 10 to remove moisture and odors from the equipment and objects. Air distributor 44 has three sections or manifolds' 46, 47 and 48. Hinge connectors 49 and 51 connect manifold 46 to central manifold 47. Manifold 48 is joined to manifold 47 with hinge connectors 52 and 53. Hinge connectors 49, 51 and 52, 53 allow end manifolds 46 and 48 to be moved upright adjacent the ends of bag 10 and folded side-by-side to facilitate shipping and storage.

Figure 11:
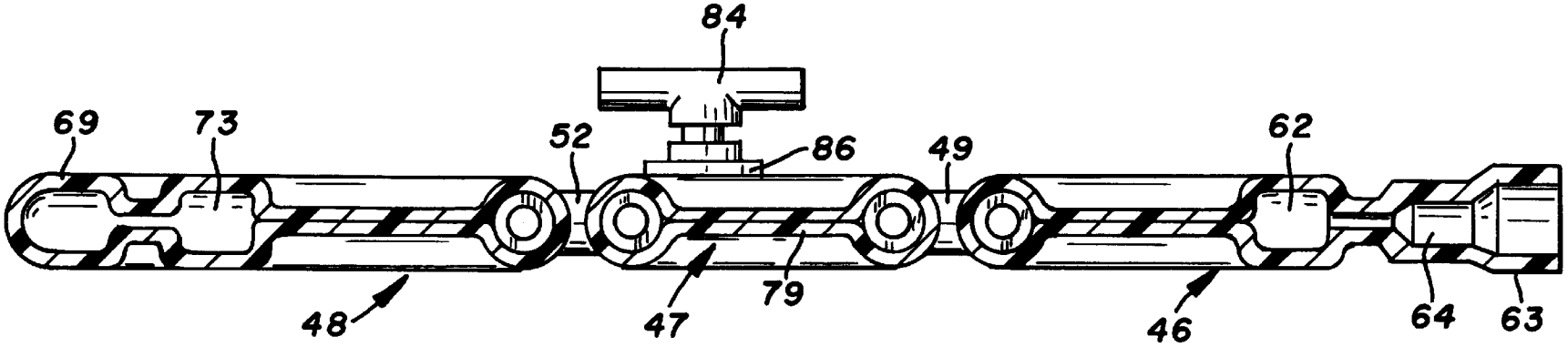
FIG. 11 is an enlarged sectional view taken along line 11—11 of FIG. 5.
Figure 12:
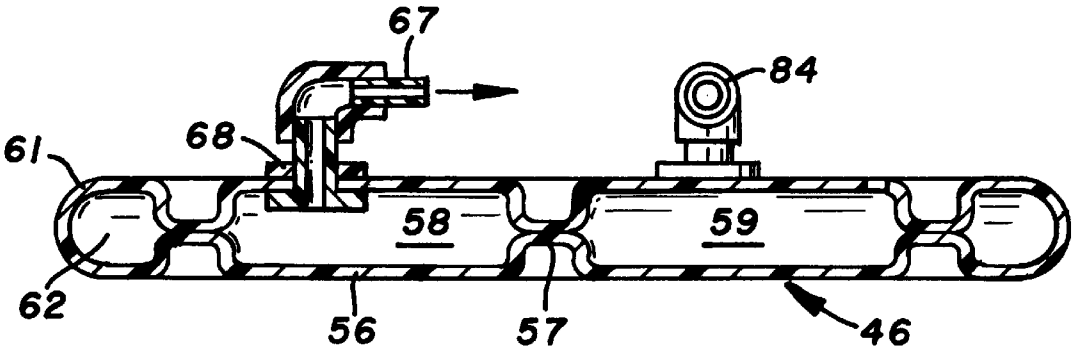
FIG. 12 is an enlarged sectional view take n along line 12—12 of FIG. 5.

Manifold 46, shown in FIG. 12, has a top wall 54 and a bottom wall 56 joined together along middle section 57 which separates air chambers 58 and 59. A U-shaped tubular edge 61 having an air passage 62 is joined to walls 54 and 56. An air inlet tube 63, shown in FIG. 11, having a passage 64 connected to tubular edge 61 directs air from blower 11 into air passage 62. Walls 54 and 56 and edge 61 are air impervious plastic members. The air blows from passage 62 through openings 63 into chambers 58 and 59 as shown in FIG. 11. Top wall 54 has a plurality of holes 66 open to chambers 58 and 59 for directing air from chambers 58 and 59 into bag chamber 24. Holes 66 are arranged in a generally square pattern adjacent the outer edge section of top wall 54 to allow air flow in the entire end of bag chamber 24.

Returning to FIGS. 5 and 12, a generally horizontal tubular member 67 in mounted on top wall 54 with a connector 68. Member 67 is used to support boots, shoes, skates, gloves, mittens, and equipment and direct air into these items to dry the interiors thereof. The tubular member can be located in a vertical position to allow gloves and mittens to be placed over the tubular member.

Manifold 48 has the same structure as manifold 46 with the exception of air inlet tube 63. A U-shaped tubular edge 69 surrounds a top wall 71 having a plurality of holes 72 for directing air into bag chamber 24. The interior of manifold 48 has two air chambers 73 which are charged with air from tubular edge 69. A horizontal tubular member 73 attached to top wall 71 with a connector 74 is used to direct air into hollow objects, such as gloves, skates, boots, shoes, mittens to dry the interiors thereof. Member 73 can be located in an upright position.

Figure 13:
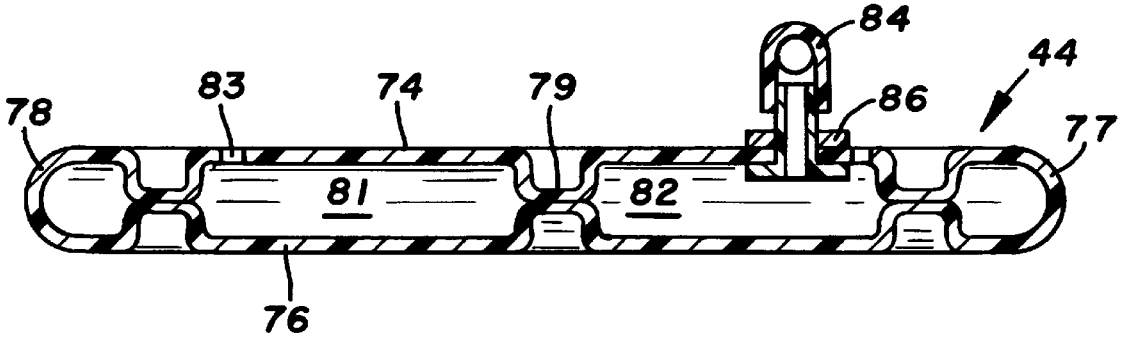
FIG. 13 is an enlarged sectional view taken along line 13—13 of FIG. 5.

As shown in FIG. 13, manifold 47 has a top wall 74 and bottom wall 76 joined to linear side tubular members' 77 and 78. The middle section 79 of walls 74 and 76 are joined to provide two air chambers 81 and 82. Top wall 74 has a plurality of holes 83 to allow air to flow from chambers 81 and 82 into the central portion of bag chamber 24. Returning to FIG. 5, holes 83 are arranged in a rectangular pattern adjacent the outer edge portions of top wall 74 to distribute air in the central area of bag chamber 24. A horizontal tubular member 84 mounted on top wall 74 with connector 86 has open opposite ends to direct air into hollow objects 85, such as skates, boots, shoes, mittens, gloves, helmets, and hats.

Figure 14:
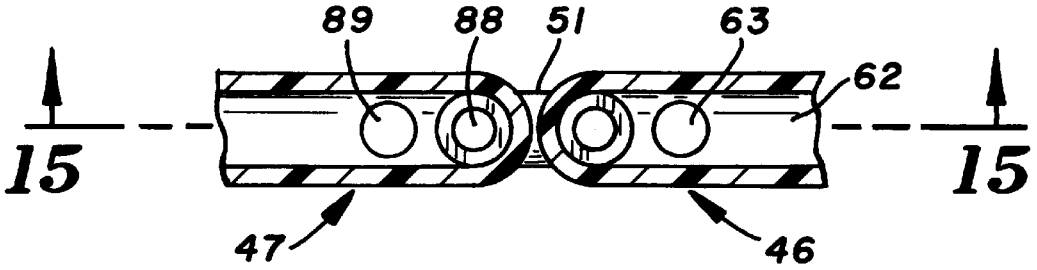
FIG. 14 is an enlarged sectional view taken along the line 14—14 of FIG. 5.
Figure 15:
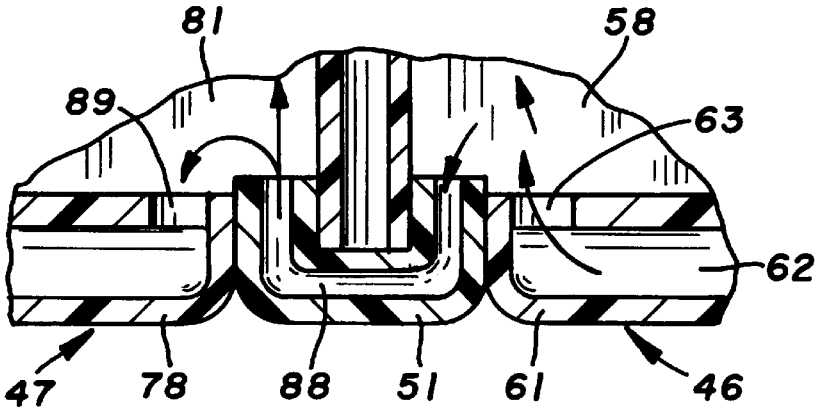
FIG. 15 is an enlarged sectional view taken along line 15—15 of FIG. 6.
Figure 16:
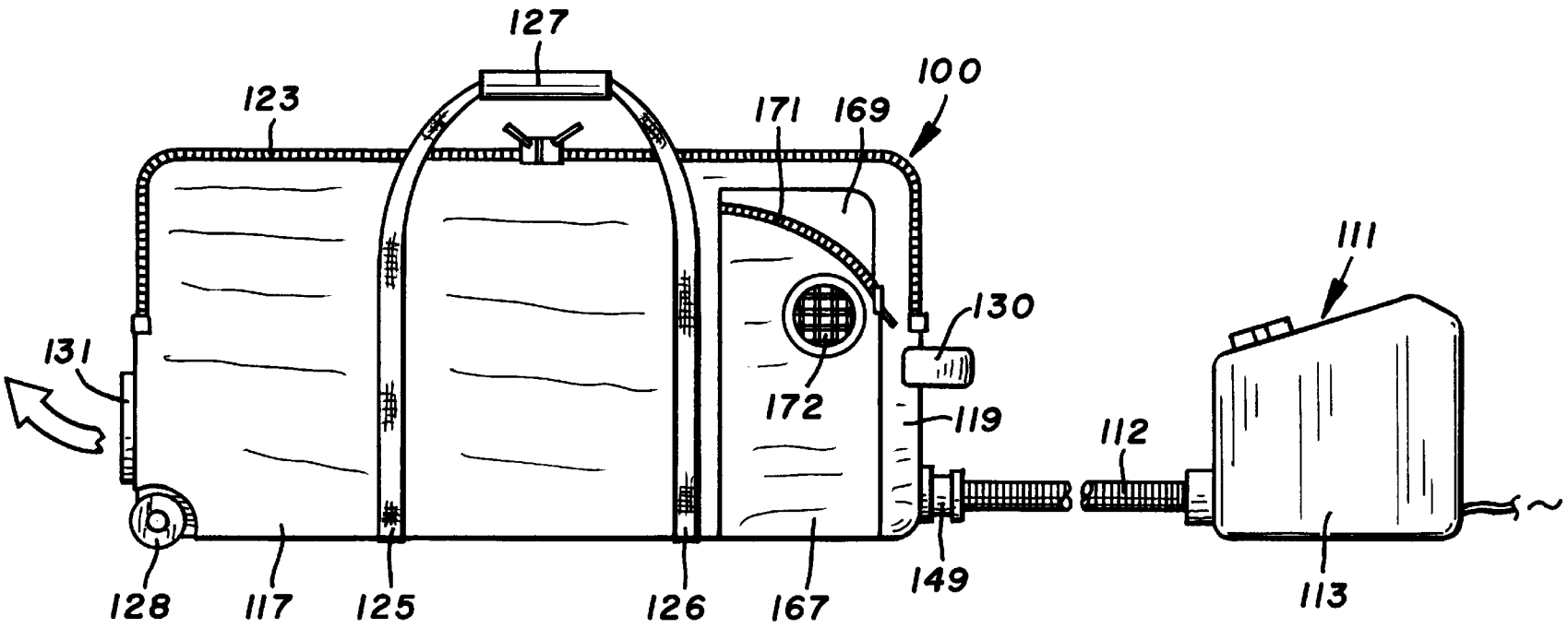
FIG. 16 is a side elevational view of a modification of the travel and sport equipment bag having an air distributor of the invention connected to an air blower.
Figure 17:
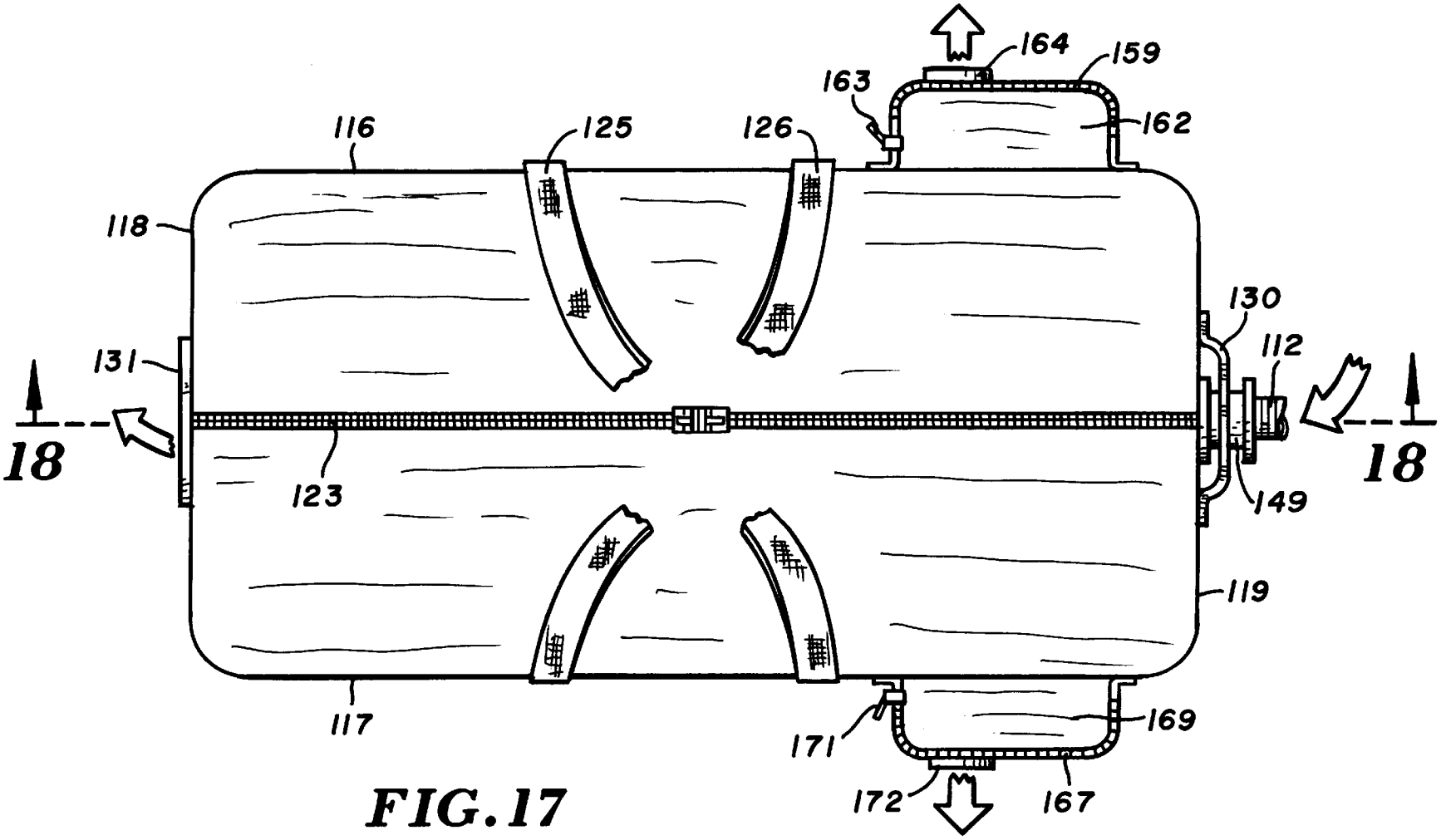
FIG. 17 is an enlarged top plan view of the bag of FIG. 16.

Hinge connector 51, shown in FIG. 14 and 15, is a U-shaped tubular member 87 having a passage 88 allowing air to flow from chamber 58 of manifold 46 into chamber 81 of manifold 47. The ends of tubular member 87 snap into lateral holes in manifolds 46 and 47 to allow manifolds 46 and 47 to pivot relative to each other. Hinge connectors 49, 52 and 53 have the same structure a hinge connector 51 to allow relative movement to manifolds 47 and 48. As shown in FIG. 15, air flows from passage 62 through hole 63 into air chamber 58. Air in chamber 58 flows through passage 88 in hinge connector 51 into chamber 81 of manifold 47 and out of chamber 81 through hole 89 into the passage of tubular member 78 leading to hinge connector 53. Connector 53 directs the air into the air chamber of manifold 48. Hinge connectors 49 and 52 also have passages that allow air to flow from manifold 46 into manifold 47 and out of manifold 47 into manifold 48.

In use, air distributor 44 is placed in bag 10 with the top walls 54, 71 and 74 of manifolds 46, 47 and 48 exposed to bag chamber 24 and equipment and objects stored in the chamber. Hose 12 connects blower 11 to air distributor 44 as shown in FIG. 1. Zipper 23 is closed to contain the equipment and objects in a closed environment. Blower 11 operated to move air through hose 12 into air distributor 44. The air flow through holes 66, 74 and 83 in manifolds 46, 47 and 48 into bag chamber 24. The air flowing through chamber picks up moisture and odors from the equipment and object in air chamber 24. The air in chamber 24 is forced through filters 31–34 which absorb odors and removes particulate from the air. The moisture ladened air is discharged into the atmosphere adjacent the top of bag 10. An ionized unit located in bag chamber 24 can be used to generate ozone to control odors in the air in chamber 24 and on the equipment stored in chamber 24.

A modification of the travel and sports bag 100, shown in FIGS. 16 to 23, is equipped with an air distributor 144 operable to direct air into bag chamber 124 to dry equipment and objects in chamber 124. Air distributor 144 is coupled to an air blower or air pump 111 with a flexible hose 112. Blower 111 has a casing 113 enclosing an electric motor drivable connected to an impeller or fan (not shown) operable to force air through hose 112 into air distributor 114. A motor control 114 mounted on casing 113 includes a timer for operating the motor for a selected period of time. Blowers 111 may include a heating element for heating the air discharged into hose 112.

Bag 100 is a flexible canvas, plastic, or fabric container used to store and carry sport equipment, such as hockey pads, breezers, soccer, football, tennis, handball, and baseball objects. The moisture on the equipment in bag chamber 124 is removed by the air flowing through chamber 124 and filter 131. Bag 100 has side walls 116 and 117 joined to end walls 118 and 119 and bottom wall 121. Zipper or linear releasable fasteners 123 are located longitudinally along the top of bag 100 to facilitate access to bag chamber 124 and permit equipment to be placed into and removed from bag chamber 124. A pair of straps 125 and 126 are secured to side walls 116 and 117. The upper portions of straps 125 and 126 extend above the top of bag 100 and provide a handle 127 used to carry bag 100. A second handle 130 secured to end wall 119 is used to lift and tow bag 100 using wheels 128. Brackets 129 secure wheels 128 to opposite lower portions of end wall 118.

Figure 22:
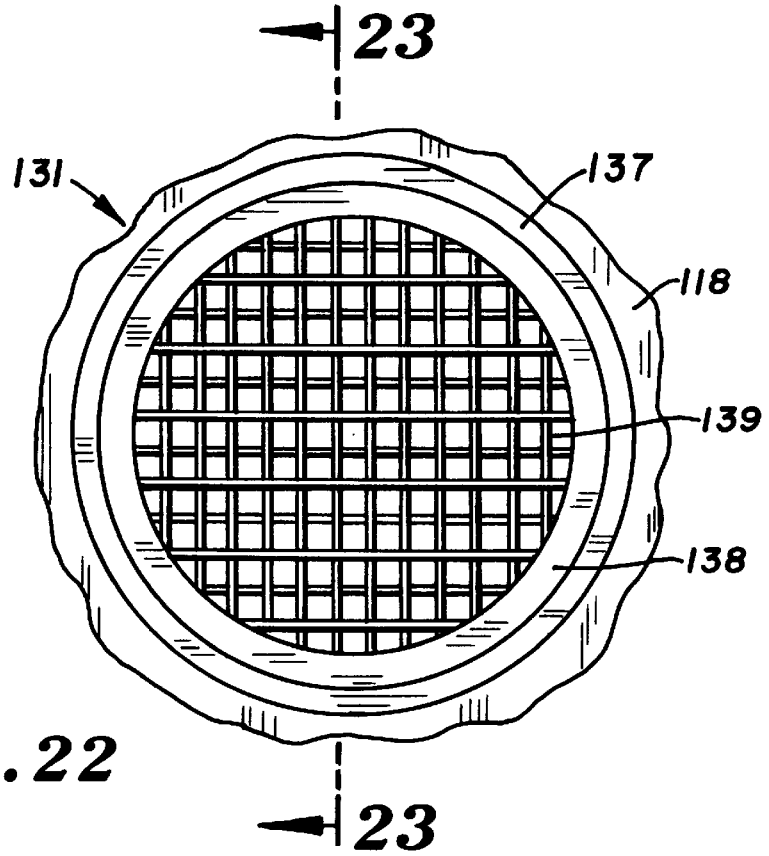
FIG. 22 is an enlarged plan view of the filter assembly attached to the end of the bag.
Figure 23:
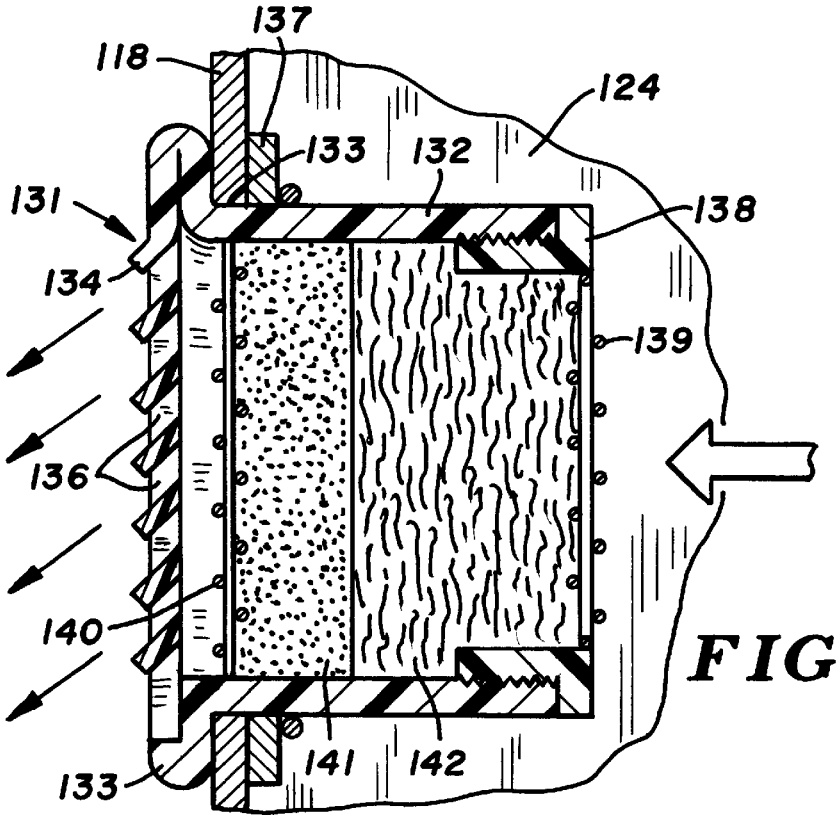
FIG. 23 is a sectional taken along line 23—23 of FIG. 22.

As shown in FIGS. 22 and 23, filter 131 has a cylindrical casing 132 extended through an opening 133 in end wall 118. Casing 132 has an annular outside flange 133 and spaced vanes 134 providing openings 136 to allow air to flow through casing 132. Awasher or ring 137 clamps flange 133 to end wall 118 to hold filter on end wall 118. An annular sleeve 138 holding a grid or screen 139 is threaded into the inner end of casing 132. As second screen 140 is located adjacent the inside of vanes 140. The space between screens 139 and 140 accommodate filter materials including a bed of charcoal 141 and fiber material 142 for removing odors, particulates, and foreign materials from the air flowing through filter 131.

Figure 18:
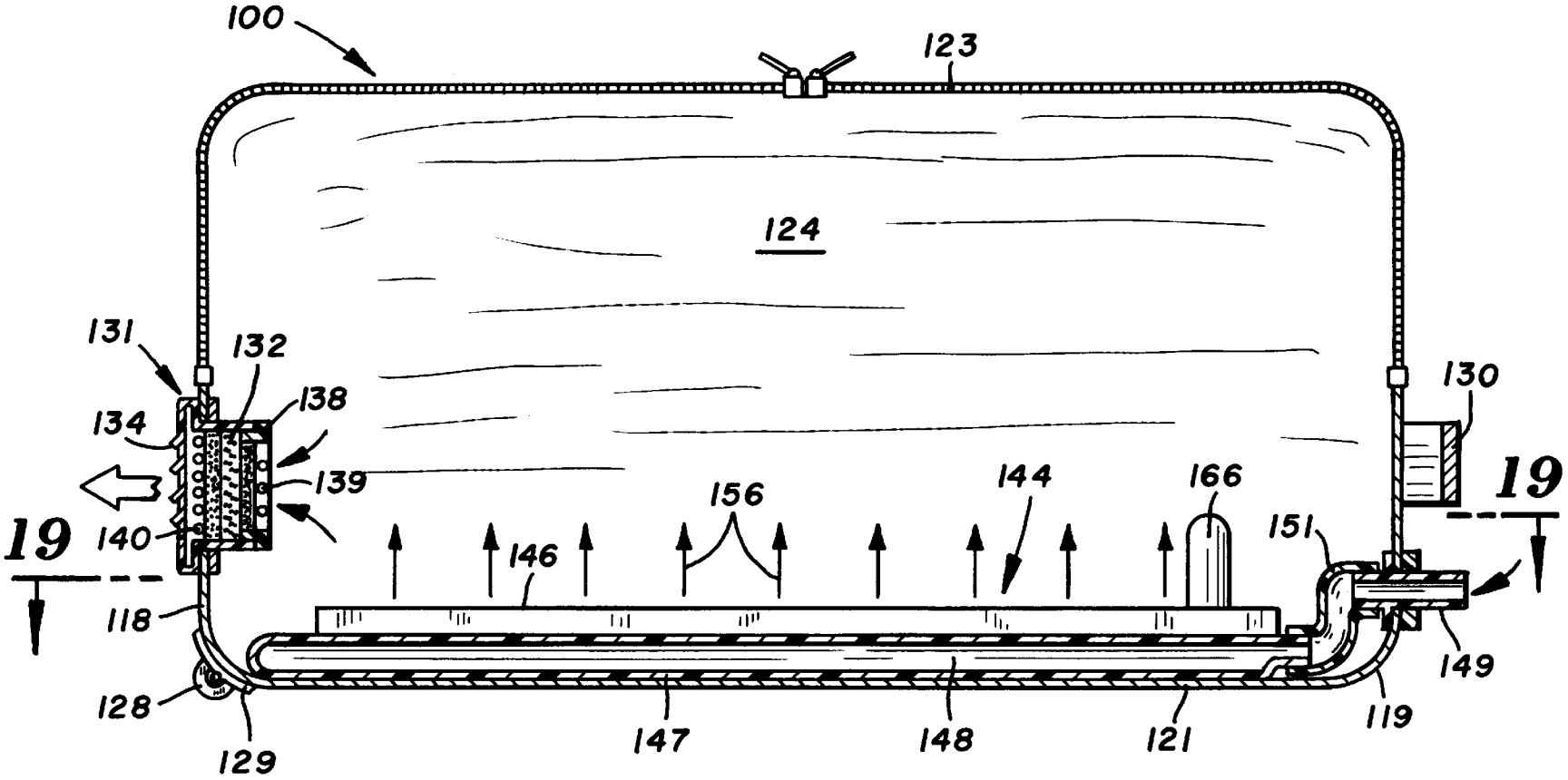
FIG. 18 is an enlarged sectional view taken along line 18—18 of FIG. 17.
Figure 19:
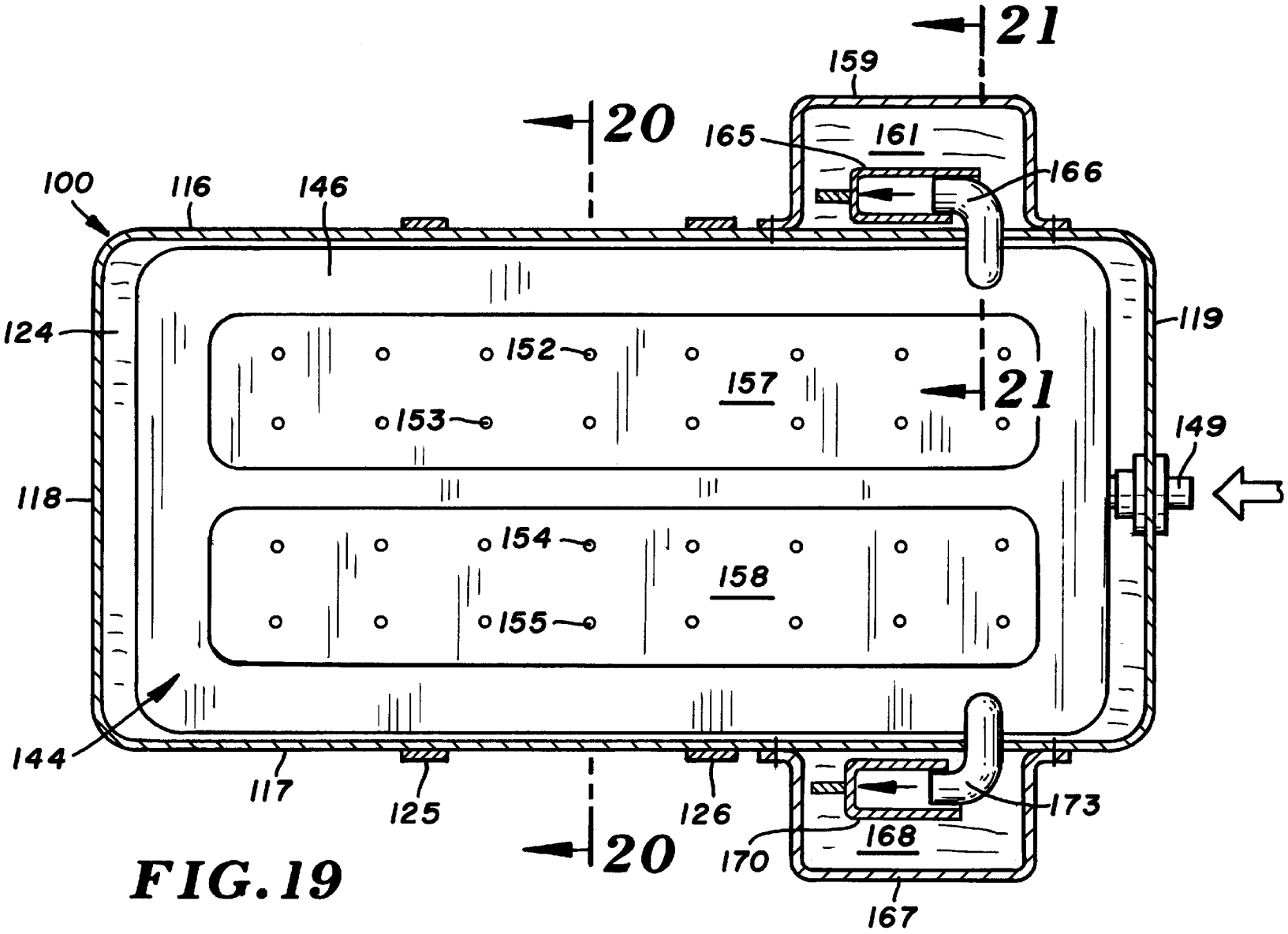
FIG. 19 is a sectional view taken along line 19—19 of FIG. 18.
Figure 20:
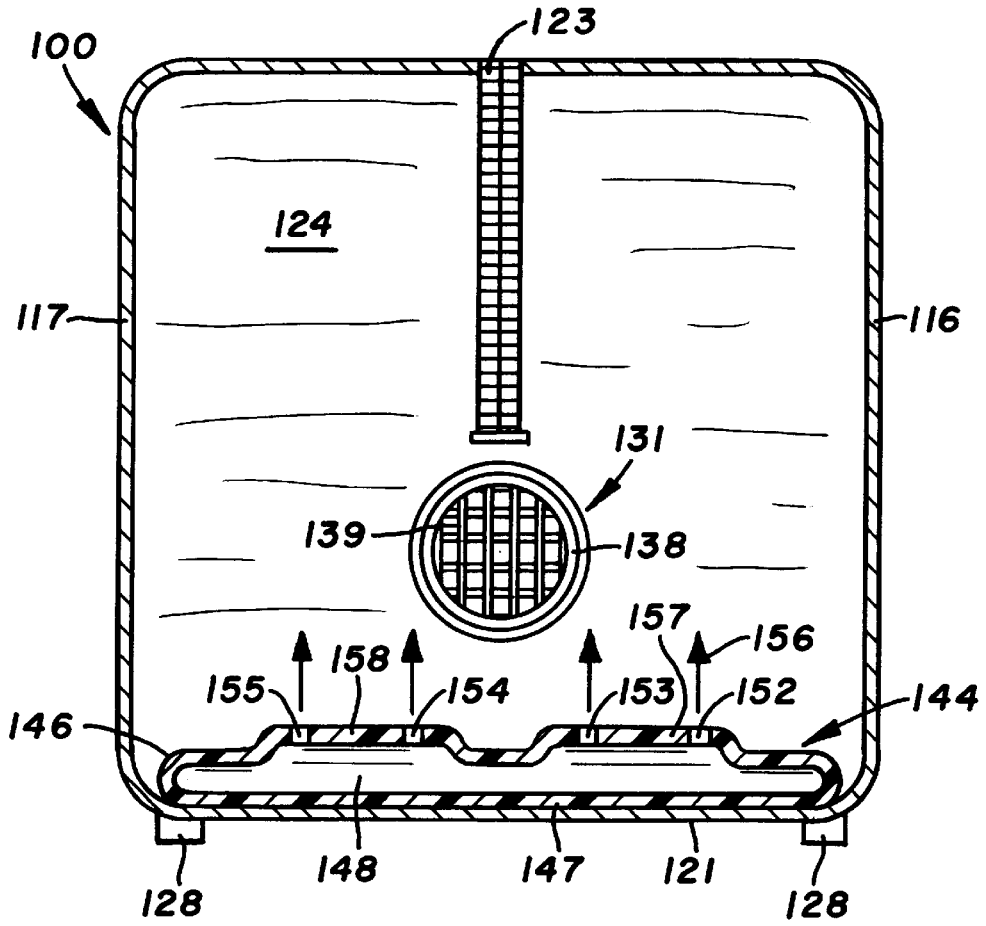
FIG. 20 is a sectional view taken along line 20—20 of FIG. 19.
Figure 21:
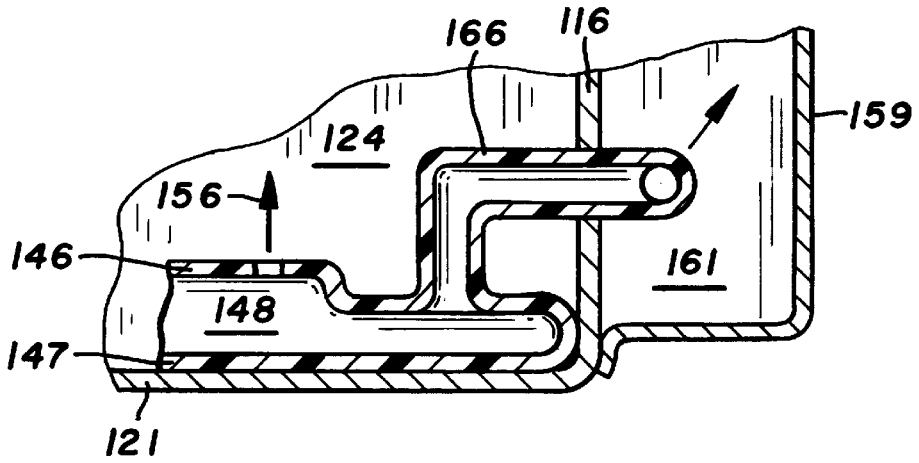
FIG. 21 is an enlarged sectional view taken along line 21—21 of FIG. 19.

Air distributor 144, shown in FIGS. 18, 19 and 20, is a generally rectangular manifold located on the bottom wall 121 of bag 100. Air distributor 144 has a top wall 146, a bottom wall 147 and an interior chamber 148. An air inlet tube 149 is attached to an end of distributor 144 adjacent wall 119 with a hose 151. Tube 149 projects through end wall 119 to accommodate hose 112 thereby allowing air to flow into manifold chamber 148. Top wall 146, as shown in FIGS. 19 and 20, has a plurality of rows of holes 152, 153, 154 and 155 open to bag chamber 124 to allow air to flow into bag chamber 124 as indicated by arrows 156 in FIGS. 18 and 20. Holes 152 and 153 are located in a raised rectangular section 157 of top wall 146. A second raised rectangular section 158 has holes 154 and 156.

A first pocket 159 secured to side wall 116 has a chamber 161 for storing a hollow object 165, such as a shoe, boot, or ice skate. The top of pocket 159 holds an air filter 164 to allow air to flow through pocket chamber 161. A curved tube 166 attached to air distributor 144 carrier air to pocket chamber 161 to dry the interior of hallow items, such as ice skates placed over the outer end of tube 166.

A second pocket 167 secured to side wall 117 has a chamber 168 for storing a hollow object 170, such as a boat, show, or ice skate. A flap 169 and zipper 171 closes the top of pocket 167. An air filter 172 mounted on pocket 167 removes odors and foreign material from the air flowing through the filter 172. A curved tube 173 attached to air distributor 144 carries air into pocket chamber 168 to dry hollow objects placed on the end tube 173. The air in pocket chambers 161 and 168 can be routed back into bag chamber 124. This eliminates the need for filters 164 and 172 as the air flows through bag filters 31, 32, 33 and 34 into the external atmosphere.

In use, blower 111 is connected with hose 112 to air inlet tube 149 whereby the blower discharges a stream of air into air distributor chamber 148. The air flows through the rows of holes 152–155 into bag chamber 124. The air moving through bag chamber 124 picks up moisture and odors from the equipment in the bag chamber 124. Filter 131 removes odors and particulates from the air flowing through the filter to the environment adjacent bag 100. Air also flows through pocket chambers 161 and 168 to remove moisture from objects 165 and 170 located in the pockets' 159 and 167. Filters 164 and 172 remove odors and foreign materials from the air flowing out of pocket chambers 161 and 168.

The bag herein described are elongated horizontal sport and equipment bags. The bags of the invention can have an upright or vertical orientation having tops that include a hanger bars to hold the bags on a fixed rod or support. The air distributors including upright air tubes are located at the bottom of the bags. One or more of the walls of the bags have zippers or other releasable fasteners that allow equipment and clothing to be placed in and removed from the interiors of the bag. Blowers and air pumps and used to supply air to the bags. Filters mounted on the bags remove odors are foreign materials from the air moving through the filters into the external atmosphere.

While there has been shown and described preferred embodiments of the bag, air distributor, and air filters of the invention, it is understood that changes in the structures, materials, and arrangement of structures can be made by these skilled in the art without departing from the invention. The invention is defined in the following claims.

I claim:

1. An apparatus for drying objects comprising: a bag having an interior chamber for accommodating objects, air distributor means located within the interior chamber of the bag, said air distributor means having chamber means for accommodating air, first means to allow air from a supply of air to flow into the chamber means, second means to allow air to flow from the chamber means into the interior chamber of the bag to dry objects in the interior chamber, and filter means mounted on the bag to remove odors from the air flowing from the interior chamber of the bag through the filter means to the environment adjacent the bag, said bag including pocket means having pocket chambers for accommodating objects to be dried, said second means including tubular means for carrying air from the chamber means into the pocket chambers to dry objects located within the pocket chamber.

2. The apparatus of claim 1 wherein: the bag has a bottom wall, and an opening providing access to the interior chamber of the bag, said air distributor means being located on said bottom wall with said second means directed away from the bottom wall to direct air upward into the interior chamber of the bag, and closure means secured to the bag for closing the opening, said closure means being operable to open the opening to provide access to the interior chamber of the bag.

3. The apparatus of claim 1 wherein: the first means is a tubular member open to the chamber means, said tubular member having a portion extended through the bag.

4. The apparatus of claim 3 including: blower means operable to generate a stream of air, and means connected to the blower means and tubular member to carry air from the blower means to the tubular member and chamber means of the air distributor.

5. The apparatus of claim 4 wherein: the means connected to the blower means and tubular member is a hose.

6. The apparatus of claim 1 wherein: the air distributor means has a wall facing the interior chamber of the bag, said second means comprising holes in said wall to allow air to flow from the chamber means of the air distributor to the interior chamber of the bag to dry objects in the bag.

7. The apparatus of claim 1 including: filter means mounted on the pocket means to remove odors from air flowing from the pocket chambers through the filter means to the environment adjacent the bag and means to open and close the pocket means.

8. The apparatus of claim 1 wherein: the filter means includes a bed of activated charcoal for removing odors from the air flowing through the filter means.

9. The apparatus of claim 1 including: wheel means secured to one of the bag for supporting the bag on a surface, and handle means secured to the other end of the bag to facilitate transport of the bag on said surface.

10. The apparatus of claim 1 wherein: the filter means includes materials for removing odors from the air flowing through the filter means.

11. The apparatus of claim 1 including: straps secured to the bag providing handles used to carry the bag.

12. An apparatus for driving objects comprising: a bag having an interior chamber for accommodating objects, air distributor means located within the interior chamber of the bag, said air distributor means having at least two manifolds, said manifolds each having chamber means for accommodating air, hinge means for movably connecting the manifolds to each other to allow movement of the manifolds relative to each other, means to carry air through the hinge means between the chamber means of the manifolds, first means to allow air from a supply of air to flow into one of the chamber means, second means to allow air to flow from the chamber means of the manifolds into the interior chamber of the bag to dry object in the interior chamber, and filter means mounted on the bag to remove odors from the air flowing from the interior chamber of the bag through the filter means to the environment adjacent the bag.

13. The apparatus of claim 12 wherein: the second means includes tubular members mounted on the manifolds for directing air into the interior chamber of the bag.

14. The apparatus of claim 12 wherein: the second means includes a plurality of holes in the manifolds to allow air to flow from the chamber means of the manifolds into the interior chamber of the bag to dry objects located in the interior chamber of the bag.

15. An apparatus for drying objects comprising: a bag having an interior chamber for accommodating objects, air distributor means located within the interior chamber of the bag, said air distributor means having chamber means for accommodating air, first means to allow air from a supply of air to flow into the chamber means, second means to allow air to flow from the chamber means into the interior chamber of the bag to dry objects in the interior chamber, and means to allow air to flow from the interior chamber of the bag to the environment adjacent the bag, said bag including pocket means having a pocket chamber for accommodating objects to be dried, said second means including means for carrying air from the chamber means of the air distributor means into the pocket chamber to dry objects located within the pocket chamber, and means to open and close the pocket means.

16. The apparatus of claim 15 wherein: the bag has a bottom wall, and an opening providing access to the interior chamber of the bag, said air distributor means being located on said bottom wall with said second means directed away from the bottom wall to direct air upward into the interior chamber of the bag, and closure means secured to the bag for closing the opening, said closure means being operable to open the opening to provide access to the interior chamber of the bag.

17. The apparatus of claim 15 wherein: the first means is a tubular member open to the chamber means, said tubular member having a portion extended through the bag.

18. The apparatus of claim 15 wherein: the air distributor means has a wall facing the interior chamber of the bag, said second means comprising holes in said wall to allow air to flow from the chamber means of the air distributor to the interior chamber of the bag to dry objects in the bag.

19. An apparatus for drying objects comprising: a bag having an interior chamber for accommodating objects, air distributor means located within the interior chamber of the bag, said air distributor means having at least two manifolds, said manifolds each having chamber means for accommodating air, hinge means for movably connecting the manifolds to allow movement of the manifolds relative to each other, means connected to the manifolds to carry air between the manifolds, first means to allow air from a supply of air to flow into one of the chamber means, second means to allow air to flow from the chamber means of the manifolds into the interior chamber of the bag to dry objects in the interior chamber, and means to allow air to flow from the interior chamber of the bag to the environment adjacent the bag.

20. The apparatus of claim 19 wherein: the second means includes a tubular member mounted on a manifold for directing air from the chamber means of the manifold into an object supported on the tubular member and the interior chamber of the bag.

21. The apparatus of claim 19 wherein: the second means includes a plurality of holes in the manifolds to allow air to flow from the chamber means of the manifolds into the interior chamber of the bag to dry objects in the interior chamber of the bag.

22. The apparatus of claim 19 wherein: the air distributor means has first, second, and third manifolds, said hinge means including a first hinge pivotally connecting the first manifold to the second manifold and a second hinge pivotally connecting the second manifold to the third manifold, and said means connected to the manifolds to carry air between the manifolds including first tubular means connected to the first and second manifolds and second tubular means connected to the second and third manifolds.

23. The apparatus of claim 19 including: wheel means secured to one end of the bag for supporting the bag on a surface, and handle means secured to the other end of the bag to facilitate transport of the bag and object therein on said surface.

24. The apparatus of claim 19 wherein: the hinge means includes U-shaped tubular members releaseably connected to adjacent portions of the manifolds to allow the manifolds to pivot on the tubular members relative to each other and carry air between the manifold chambers.

25. The apparatus of claim 19 wherein: the means to allow air to flow from the interior chamber of the bag includes filter means mounted on the bag to remove odors from the air flowing through the filter means to the environment adjacent the bag.

26. The apparatus of claim 25 wherein: the filter means includes charcoal means and fiber materials for removing odors, particulates and foreign materials from the air flowing through the charcoal means and fiber materials.

27. The apparatus of claim 19 including: straps secured to the bag providing handles used to manually carry the bag containing the objects.

28. An apparatus for drying objects comprising: a bag having a bottom wall, an interior chamber for accommodating objects, an opening providing access to the interior chamber of the bag, and closure means secured to the bag for closing the opening, said closure means being operable to open the opening to provide access to the interior chamber of the bag, air distributor means in the interior chamber located on said bottom wall for directing air into the interior chamber, said air distributor means having a top wall facing said interior chamber and chamber means for accommodating air, tubular means extended upwardly from the top wall for supporting an object in the interior chamber, said tubular means having a passage open to the interior chamber of the bag and the chamber means for allowing air to flow from the chamber means to the object supported on the tubular means and the interior chamber of the bag, means mounting the tubular means on the top wall of the air distributor means whereby the top wall and tubular means supports the object in the interior chamber of the bag, first means to allow air from an external supply of air under pressure to flow into the chamber means, the air in the chamber means flows through the passage of the tubular means to the object on the tubular means to dry said object and the interior chamber of the bag, and second means to allow air to flow from the interior chamber of the bag to the environment adjacent the bag.

29. The apparatus of claim 28 wherein: said top wall of the air distributor means has a plurality of holes to allow air to flow from the chamber means into the interior chamber of the bag to dry objects located in the interior chamber of the bag.

30. The apparatus of claim 28 including: wheel means secured to one end of the bag for supporting the bag on a surface, and handle means secured to the other end of the bag to facilitate transport of the bag on said surface.

31. The apparatus of claim 28 including: straps secured to the bag providing handles to manually carry the bag containing the objects.

32. The apparatus of claim 28 wherein: the means to allow air to flow from the interior chamber of the bag includes filter means mounted on the bag to remove odors from the air flowing through the filter means to the environment adjacent the bag.

33. The apparatus of claim 32 wherein: the filter means includes charcoal means and fiber materials for removing odors, particulates and foreign materials from the air flowing through the charcoal means and fiber materials.

34. A method of removing moisture and odors from objects and storing the objects in a bag having an enclosed interior chamber and an air distributor having chamber means for accommodating air and passage to allow air to flow from the chamber means into the interior chamber of the bag comprising:

confining the objects within the enclosed interior chamber of the bag, introducing air into the chamber means of the air distributor, dispensing air from the air distributor into the interior chamber through the passage of the air distributor to remove moisture and odors from the objects located in the chamber;

exhausting air from the chamber into the environment, filtering the air exhausting from the interior chamber to remove odors from the air exhausted into the environment, storing the dried objects in the interior chamber of the bag, and transporting the bag with the stored dried objects to selected locations.

35. The method of claim 34 including: heating the air introduced into the chamber means of the air distributor.

36. The method of claim 34 including: storing an object in a second chamber in the bag separated from the enclosed chamber, and directing air from the passage of the air distributor into the second chamber to remove moisture and odors from the object in the second chamber, and exhausting air from the second chamber.

37. The method of claim 36 including: filtering the air exhausting from the second chamber to remove odors from the air exhausting from the second chamber.

38. The method of claim 34 including: supporting an object on a tubular member mounted on the air distributor and extended into the interior chamber of the bag, and directing air from the chamber means through the tubular member to the object on the tubular member to dry the object on the tubular member.

* * * * *